US007654214B2

(12) United States Patent
Rupp, II

(10) Patent No.: US 7,654,214 B2
(45) Date of Patent: Feb. 2, 2010

(54) HYDRAULIC OPERATED LOCKING AND RELEASE ACTUATOR FOR USE WITH FISHING OUTRIGGERS

(75) Inventor: Herbert Rupp, II, Port Salerno, FL (US)

(73) Assignee: Rupp Marine, Inc., Port Salerno, FL (US)

( * ) Notice: Subject to any disclaimer, the term of this patent is extended or adjusted under 35 U.S.C. 154(b) by 210 days.

(21) Appl. No.: 12/020,320

(22) Filed: Jan. 25, 2008

(65) Prior Publication Data

US 2009/0188422 A1 Jul. 30, 2009

(51) Int. Cl.
*B63B 35/14* (2006.01)

(52) U.S. Cl. ..... 114/255

(58) Field of Classification Search ..... 43/27.4; 114/255

See application file for complete search history.

(56) References Cited

U.S. PATENT DOCUMENTS

| | | | | |
|---|---|---|---|---|
| 4,115,897 | A * | 9/1978 | Zunkel | 16/49 |
| 4,813,171 | A | 3/1989 | Cooper et al. | |
| 5,191,852 | A | 3/1993 | Rupp | |
| 6,769,377 | B2 | 8/2004 | Rupp, II | |
| 6,928,766 | B1 | 8/2005 | Goebel et al. | |
| 2009/0007465 | A1 * | 1/2009 | Robl et al. | 37/468 |

* cited by examiner

*Primary Examiner*—Stephen Avila
(74) *Attorney, Agent, or Firm*—McHale & Slavin, P.A.

(57) ABSTRACT

An outrigger securing assembly for use on a fishing vessel. The securing assembling includes an automatic locking member that is secured to a structural member of the vessel and is capable of latching or releasing a latch member that is secured to an outrigger mast. The automatic locking member is equipped with a latching actuator that can release the latch member. The latching actuator can be operated either manually or hydraulically from a control device removed from the automatic locking member.

12 Claims, 3 Drawing Sheets

HYDRAULIC OPERATED LOCKING AND RELEASE ACTUATOR FOR USE WITH FISHING OUTRIGGERS

FIELD OF THE INVENTION

The invention relates to the field of fishing and, in particular, to an assembly for securing outriggers on a vessel, the assembly provides a locking and hydraulic activated release system.

BACKGROUND OF THE INVENTION

Outriggers for use in fishing have been well received on sport fishing and open fishing vessels. Deployed outriggers allow a vessel to position bait over a wide area behind the vessel as the fishing vessel is driven slowly, commonly referred to as trolling. Trolling with outriggers permit a fishing vessel to cover a large area of water so as to increase the opportunity for catching fish. The quantity and spacing of bait placed behind the vessel is generally proportional to the size of the vessel, the use of large outriggers maximize the benefit. Outriggers must be properly secured when traversing rolling seas to prevent accidental deployment. Larger outriggers necessitate the need for stronger locking and safer release systems.

If the bait is properly placed, the wake of the vessel can be made to appear like a school of fish. Bait that can be made to appear to be struggling or separated from the school is most attractive to predator fish.

Positioning of bait behind a vessel would be limited but for the use of outriggers. Most fishing boats have a beam of less than fifteen feet wherein trolling with more than couple of fishing lines provides very little distance between the baited hooks and limits the ability to place bait outside of the boat wake. In addition, more than two lines behind a vessel severely limits the vessels ability to maneuver as even a gradual turn may cause bait lines to cross and become entangled. Likewise, closely positioned baits may become entangled as the fish is reeled into the vessel.

Thus, the use of outriggers provides a means for effectively increasing the spacing of the bait, as well as adding additional bait lines without increasing the possibility entangling these lines while landing a fish. An outrigger is basically a long pole having a proximal end attached to the vessel and a distal end that can be moved from a stowage position adjacent the vessel to a deployed position away from the vessel to a trolling position. A positioning line is drawn along the length of the outrigger pole wherein release clips secured to the positioning line are used to secure the fishing pole line to a desired location. When a fish strikes the bait, the release clip disengages the fishing line from the positioning line, and the fisherman is free to reel in the fish without interference. The proper placement of the outrigger pole and fishing line increase the chances of fish being drawn to the bait.

For example, by use of two fifteen foot outriggers, a vessel with a ten foot beam may extend the distances between bait, effectively covering a thirty foot spread behind the vessel. However, having outrigger poles extend from each side of a vessel during non-fishing time has obvious drawbacks. Typically outriggers are deployed only when fishing or trolling at relatively slow speeds such as five knots or less. For this reason, outriggers must be stowable to allow for normal cruising and docking such that the vessel will not interfere with marine navigation. The outriggers are typically stowed within the vertical plane of the vessel, which is defined by the side walls of the vessel. While stowed, the outriggers will not obstruct or interfere with other vessels or any other fixed objects in the path of the vessel. In operation, the outrigger is swung laterally outward to a deployed position for fishing purposes. In addition, when a vessel is placed in an ocean environment it is not uncommon for the vessel to be subjected to large seas wherein the outrigger and its mounting structure is subjected to large twisting forces.

For the aforementioned reasons it is therefore desirable to provide the vessel with a device capable of quickly securing and deploying the outriggers. The device will enable the vessel's captain or crew to quickly and easily release the outriggers from a stowed position to a deployed position wherein the outriggers are positioned away from the vessel. Likewise, it is also desirable to provide the vessel with a device that can also quickly, safely and easily stow and secure the outriggers on board the vessel when they are not in use.

DESCRIPTION OF THE PRIOR ART

Prior art outrigger systems employ a locking device that will secure the outrigger in the stowed position and allow the outrigger to freely move about its support base when the locking device is removed from the outrigger. As a control situation may arise when the outrigger is unlocked and the vessel is being subjected to movement induced by wave displacement a locking device has been incorporated into the design. Ease of operation and safety of the outrigger system is a necessary requirement. The prior art has attempted to address this problems in a number of ways.

U.S. Pat. No. 6,928,766, issued to Goebel et al, discloses an automatic outrigger securing assembly for use on a fishing boat. The securing assembly includes a coupler for releasably securing the outrigger in a fixed position, as well a collar assembly for interfacing with the coupler. The coupler receives and locks the collar in a select position and also includes a release mechanism for the collar. When the outrigger is in a lay down or collapsed configuration, the securing assembly automatically receives and retains the outrigger in a desired position, and can also automatically release the outrigger. In one embodiment the outrigger is released manually by a release pin and in an alternate embodiment the outrigger is released hydraulically without a manual actuator.

U.S. Pat. No. 6,769,377, to Herbert Rupp, discloses a gear driven outrigger device for use on a fishing vessel having a first tubular member for holding an outrigger pole, which is rotatably journaled to a second tubular member that is mounted to a fixed structure. The second tubular member housing a gear train driver assembly that allows manual or motor driven rotation of the outrigger pole. The gear driven assembly can be locked into position by use of a slotted aperture in a support post which allows a pivoted engagement bracket to engage the slot and prevent rotation thereof.

U.S. Pat. No. 5,191,852, to Herbert Rupp, discloses an outrigger device for use with a motor boat upon which the device can be mounted for movement between and inboard storage position and an outboard trolling position. It includes a tube unit, a position unit moveable relative to the tube unit and a lock unit to releasably prevent such relative movement. The lock unit includes a collar through which the elongated tube extends for sliding movement of the collar along the elongated tube and a cam member having a lever extending therefrom by which the cam member may be moved between a lock position which prevents the collar to slide along the tube and an unlock position which permits such collar sliding movement. The device also has a release pin system which allows the outrigger device to be lowered fore and aft for bridge clearance or the like.

U.S. Pat. No. 4,813,171, issued to Cooper et al, discloses a fishing outrigger having a mast with one end pivotally attached to the side of a boat and at least one collar disposed in the vicinity of the other end of the mast for guiding fishing lines. A power operated actuator for the outrigger includes a housing pivotally attached to the side of the boat, a drive disposed in the housing, and a rod connected to the drive and pivotally attached to the other end of the mast for pivoting the mast toward and away from the side of the boat about the given point. The patent also describes a prior art securing device wherein a catch is placed over a hook (as shown in FIG. 1).

Thus, it desirable to provide an outrigger mounting system that is capable of quickly securing and deploying the outriggers. The device will enable the vessel's crew to quickly and easily release the outriggers from a stowed position to a deployed position wherein the outriggers are positioned away from the vessel. Likewise, it is also desirable to provide the vessel with a device that can also quickly, safely and easily stow and secure the outriggers on board the vessel when they are not in use.

SUMMARY OF THE INVENTION

Disclosed is an improved automatic locking assembly capable of securing an outrigger in a storage position along the side of a fishing vessel. The improved automatic locking member is attached to a structural member of the vessel at one end and the opposite end of the automatic locking assembly includes an aperture configured to receive a latching member secured to the mast of the outrigger. The automatic locking member includes a latching actuator mounted for pivotal motion therein. The pivoting motion the latching member is capable of either retaining or releasing the latching member and hence the outrigger. The latching member is biased into a position to retain the latching member within the automatic locking member. The latching member can be pivoted into a position to release the latching member either manually or hydraulically. The hydraulic actuator enables ease of operation from a remote location requiring less physical effort or attention to effect release of the latching member. The manual actuator, located on the latching actuator, provides the user with a convenient alternative to remote actuation while at the same time providing the added safety of a redundant operating alternative should the hydraulic system fail to actuate the release for whatever reason.

The latching member includes two generally frusto conical members that are secured in axial alignment to one another and together they are affixed to the outrigger mast with a clamping device. The two frusto conical members are sized and configured to pass through an aperture formed in the automatic locking member. Upon insertion into the aperture the conical surface on one of the frusto conical members will cause the latching actuator to pivot in such a way so as to allow a retaining portion of the latching member to ride along the conical surface and then engage and retain a flat surface of the frusto conical member to retain the latching member within the automatic locking member.

The latching actuator can be moved to a release position either manually or hydraulically. The automatic locking member includes a hydraulic cylinder and piston. To effect release of the latching member and the outrigger a suitable control device would be activated to move the hydraulic piston into position to cause the latching actuator to release the latching member. The latching actuator also includes an activation surface in the form a trigger like element that extends beyond the exterior housing of the automatic locking member. Should the crew desire to activate the latching member manually they need merely pivot the latching actuator against the force of the biasing element to release the latching element from the automatic lock member.

The automatic lock member of the present invention provides an improved automatic locking system for outriggers. It can eliminate the use of rope, hinges, mechanical latches, pins, chains, hooks, etc. The ability to latch and release with minimal effort allows the captain and crew to tend to other matters pertaining to the ships operations or to take quick and effective actions in response to dangerous or emergency conditions. In addition, it is very important to provide and safe, effect and reliable system. The incorporation of a manual actuator in addition to the hydraulic operator adds an added dimension of flexibility of use while at the same time providing an additional layer of safety should the hydraulic system malfunction or otherwise be inoperable if the vessel's power plants should fail.

Accordingly, it is an objective of the instant invention to provide an automatic outrigger securing assembly that is reliable, efficient, and easy to use.

It is a further objective of the instant invention to provide an automatic outrigger securing assembly that gives the captain or crew the option of releasing the outrigger hydraulically from a remote location or to release outrigger manually at the automatic locking member.

It is yet another objective of the instant invention to provide an automatic outrigger securing assembly that allows for manual release of the outrigger either as a matter of preference or a matter of necessity in the event of a hydraulic fluid failure.

It is a still further objective of the invention to provide an automatic outrigger securing system that can be installed as original equipment or likewise be retrofitted into an existing vessel.

Other objectives and advantages of this invention will become apparent from the following description taken in conjunction with any accompanying drawings wherein are set forth, by way of illustration and example, certain embodiments of this invention. Any drawings contained herein constitute a part of this specification and include exemplary embodiments of the present invention and illustrate various objects and features thereof.

DETAILED DESCRIPTION OF THE INVENTION

Figure 1:
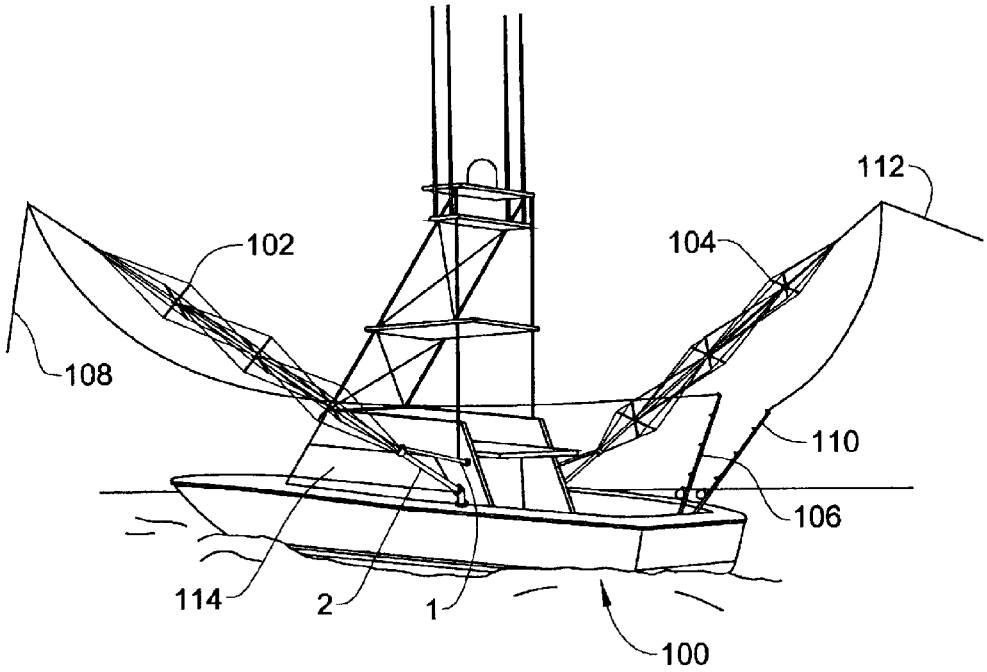
FIG. 1 is a pictorial representation of a fishing vessel with the outriggers deployed in their operative position.

Referring now to FIG. 1, pictorially illustrated is a fishing vessel depicting portside outriggers 102 and starboard outriggers 104 each shown in a deployed position. In the deployed position, the outriggers are used for positioning bait outboard of the vessel, the distance dependant upon the length of the outriggers. Fishing pole 106 placed in a rod holder is shown with fishing line 108 for strategic placement of bait outside, similarly fishing pole 110 is shown with fishing line 112 for strategic placement of the bait along the starboard side. When the outriggers are not in use, the outriggers are placed in a position approximately vertical to the house 114. The positioning of the outriggers is disclosed in the Inventor's earlier U.S. Pat. No. 5,191,852 the contents of which is incorporated herein by reference.

Now referring to FIGS. 2 through 5, set forth is the automatic locking member 1 of the automatic outrigger securing system of the instant invention. The system as shown also includes outrigger mast 2 and latching member 4. The automatic locking member 1 is mounted to the vessel 3 at a suitable location. The location could be chosen from a number of different structural members such as the vessel's hull, a gunnel, the deck, a cabin or another type of appropriate support member on the vessel.

In practice, outriggers are deployed from a retracted position. In the retracted position the outrigger is in its closest position to the sides of the vessel, the gunnels, the cabins or other support structure of the vessel. The outriggers extend towards the stern of the vessel in their lower-most position so as to provide the least amount of obstruction for cruising or docking. The inboard end 10 of automatic locking member 1 is mounted on the vessel to secure the outrigger in this retracted position.

A generally "L" shaped latching actuator 5 is pivotally mounted with the automatic locking member 1. The latching actuator 5 includes an aperture 31 which cooperates with pivot support member 32. A biasing element such as coil spring 6 acts on one end of the "L" shaped member to hold the latching actuator 5 into a position to engage the latching member 4. Latching actuator 5 includes a first activation surface 7 in the form of a trigger like protrusion that extends from the "L" shaped member to a location external of the automatic locking member 1. A manual force exerted on first activation surface 7 will impart a pivotal motion unto latching actuator 5 against the force exerted by biasing element 6. Upon exertion of sufficient force, latching actuator 5 will pivot such that the latching actuator will disengage from the latching member 4 thereby releasing the outrigger mast 2 from the automatic locking member 1.

Figure 2:
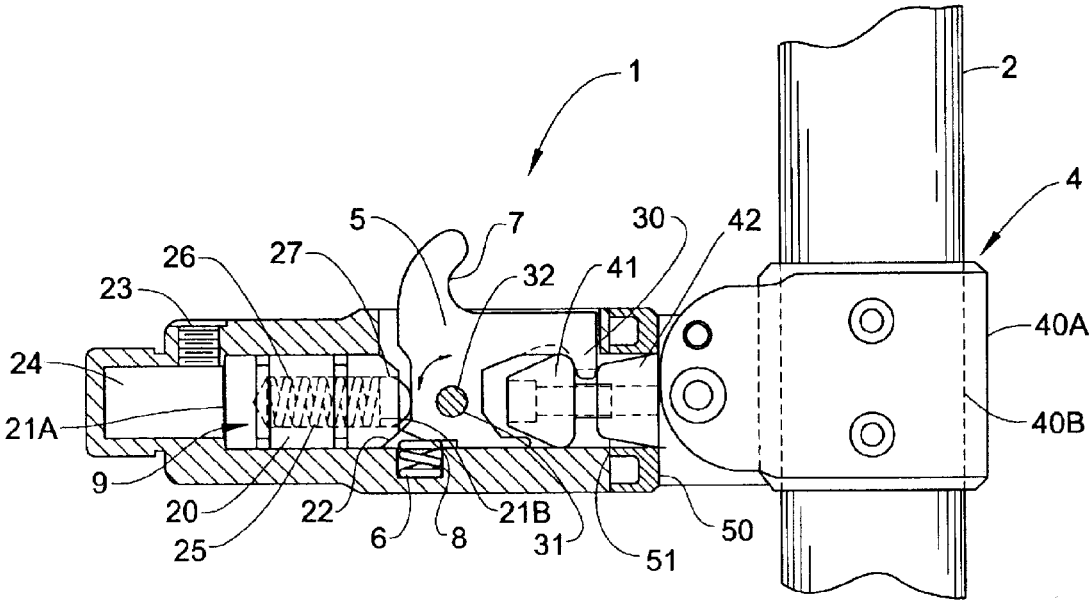
FIG. 2 is a partial cross sectional side view of the invention with the automatic locking member in the latched position.
Figure 3:
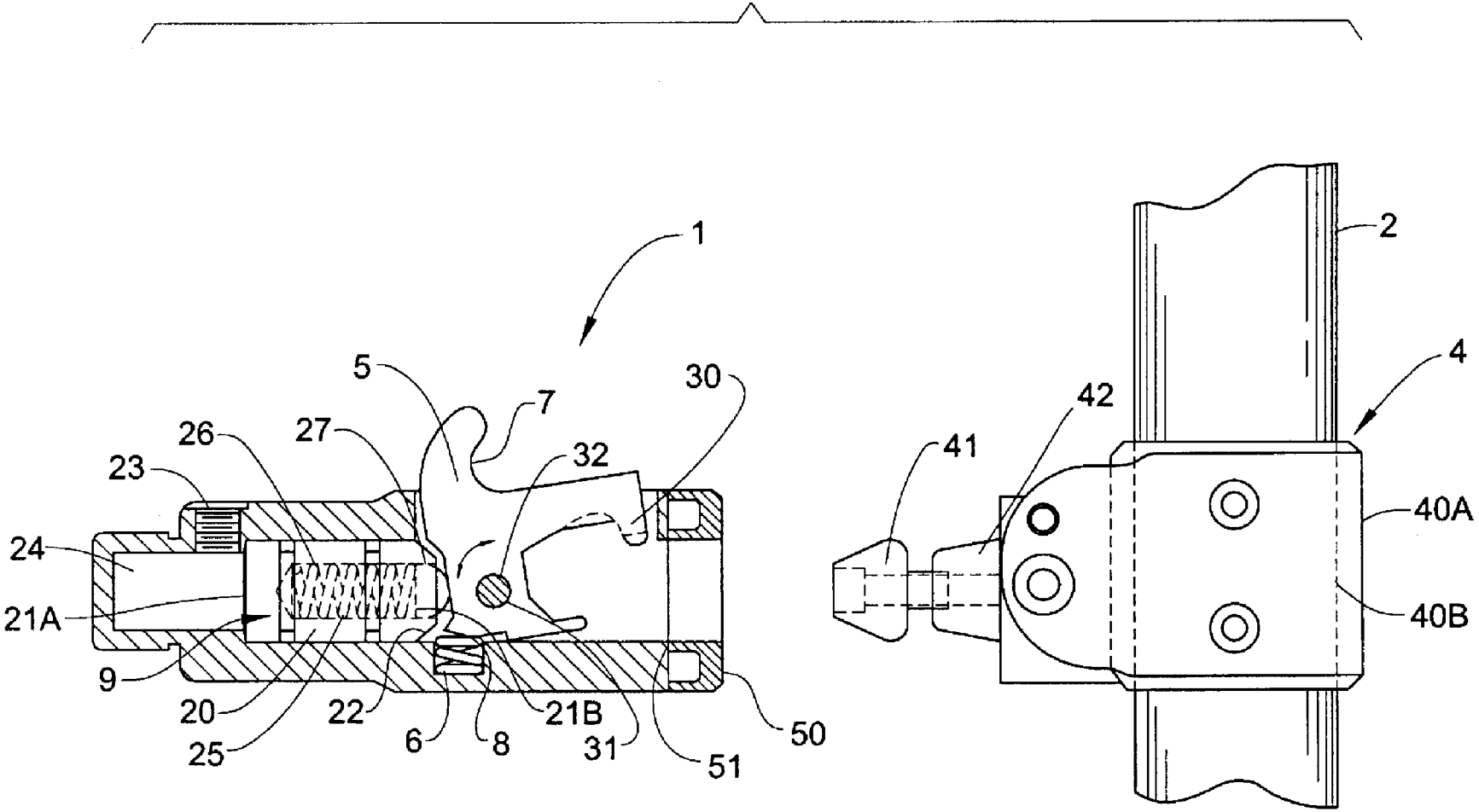
FIG. 3 is a partial cross sectional side view of the invention with the automatic locking member in the unlatched position.

The automatic locking member 1 also includes a hydraulic actuator generally shown as element 9. The hydraulic actuator 9 includes a cylindrical hydraulic piston 20 received within a cylindrical bore within automatic locking member 1. Appropriate seals are located between hydraulic piston 20 and the cylinder bore. Automatic locking member 1 includes a hydraulic fluid inlet 23 which feeds hydraulic fluid into hydraulic pressure chamber 24. The pressure within hydraulic pressure chamber 24 exerts a force on circular end surface 21A of hydraulic piston 20. The opposite end of hydraulic cylinder 20 includes a second end surface 21B. Second end surface 21B is formed in the shape of a conical surface. A second activation surface 8 is formed on the generally "L" shaped member of the latching actuator 5. Activation surface 8 and second end surfaces 21B are configured to be in operative engagement under certain conditions that will be described in more detail to follow. Also contained within hydraulic piston 20 is a cylindrical bore 25. Bore 25 is positioned along the longitudinal axis of hydraulic piston 20 and is open on the second end surface 21B and closed within the piston 20. Contained within bore 25 is a biasing member 26 in the form of a coil spring. The biasing member 25 is placed within the bore so that one end thereof bears against the closed end of the bore. Placed on the opposite end of the biasing member 26 is a bearing member 27, which can be spherical in shape as shown in FIGS. 2 and 3. In an assembled condition the bearing member 27 is resiliently positioned between the biasing member 26 and latching actuator 5. The hydraulic fluid in communication with the hydraulic chamber 24 acts upon the first surface 21A of piston with a first force and the biasing member 26 carried within the piston bore 25 acts upon hydraulic piston 20 with a second force. The first and second forces act upon the piston in opposite directions. When remote hydraulic release is desired, a control switch is activated which increases the pressure within hydraulic pressure chamber 24. When the first force produced by the hydraulic fluid exceeds the second force produced by the biasing member 26 the piston is moved in a direction away from the hydraulic pressure chamber 24 and towards the latching actuator 5. As the piston is moved towards the latching actuator 5, the bearing member 27 is moved further into the bore 25 thereby compressing the biasing member 26 carried within bore 25 located in hydraulic piston 20. At the same time, the second end surface 21B of the hydraulic piston 20, which is formed as a conical surface, moves into operative engagement with the second activation surface 8 of the latching actuator 5. As surface 21B engages and then moves second activation surface 8 it imparts a pivotal movement of latching member 5.

The latching actuator 5 is shaped generally as an "L". A biasing element 6, shown as a coil spring in FIGS. 2 and 3, acts upon one end of the "L" shaped member. The opposite end of the "L" shaped member includes a retaining portion 30 for engagement with a frusto conical member 41 which is a component of the latching member 4. The actuator member 5 also includes as aperture 31 formed between the ends of the generally "L" shaped member which is configured to receive a pivot support member 32 which is held in fixed within the automatic locking member 1 thereby enabling actuator 5 to pivot within the automatic locking member 1.

The latching member 4 includes a pair of clamps 40A and 40B configured to conform to the outer surface of mast 2, when fastened to one another, so that the latching member 4 can be securely attached to the mast 2. The latching member also includes a first generally frusto conical member 41 having a first flat surface, a second flat surface, a conical surface and a rounded surface interposed between the conical surface and the second flat surface. The latching member 4 also includes a second generally frusto conical member 42 having a conical surface interposed between opposing flat faces. The first generally frusto conical member 41 and the second generally frusto conical member 42 each are each provided with an aperture along a center line extending between there respective end faces configured to receive a mechanical fastener for securing the frusto conical members 41 and 42 to the clamps 40A and 40B.

The automatic locking member 1 includes an opening 51 located on an end opposite the hydraulic fluid chamber 24. Opening 51 is configured to receive frusto conical members 41 and 42 of the latching member 4. A resilient annular ring 50 is secured to auto locking member 1 and encircles opening 51. Resilient annular ring 50 acts a guide for frusto conical members 41 and 42 entering the automatic locking member 1 and at the same time protects them and the locking member from harsh impacts that may cause damage to the components as they a brought together.

The outrigger securing system operates in the following manner. When the outriggers are brought in towards the vessel from their deployed position to a stowed position the latching member 4 must be brought into engagement with automatic locking member 1. The latching member 4 includes two generally frusto conical members 41 and 42 that are secured in axial alignment and are affixed to the outrigger 2 mast with a clamping device 40A and 40B. The two frusto conical members 41 and 42 are sized and configured to pass through an aperture 51 formed in the automatic locking member 1. Upon insertion into the aperture 51 the conical surface on the first frusto conical member 41 will cause the latching actuator 5 to pivot in such a way so as to allow a retaining portion 30 of the latching actuator 5 to ride along the conical surface of member 41 and then engage and retain a flat surface of the frusto conical member 41 to retain the latching member within the automatic locking member. The biasing element 6 urges the latching actuator 5 into a position to ride along the conical surface of member 41. Once the retaining portion 30 of the latching actuator member 5 clears the conical surface and the rounded surface it will then engage the flat surface and maintain the latching actuator 5 in a locked position under the influence of biasing element 6.

When the outrigger masts are to be deployed, the latching member 4 ca n be released from the automatic locking member 1 either manually or hydraulically. The latching actuator 5 can be pivoted manually, against the force exerted by biasing element 6, by exerting a force on the first activation surface 7. First activation surface 7 is a trigger like protrusion extending from the generally "L" shaped member to a location external of the housing for the automatic locking member 1. The outrigger masts 2 are shown in their deployed configuration in FIG. 1.

Alternatively, the automatic locking member 1 can release the latching member 4 hydraulically. The latching actuator 5 can be pivoted hydraulically by the application of sufficient hydraulic pressure in hydraulic pressure chamber 24. This can be controlled from a remote location, such as the vessel's helm, tower, etc. When the hydraulic pressure in chamber 24 is sufficient to generate a force to overcome the force exerted by biasing member 26 the hydraulic piston 20 will move away from chamber 24 towards latching actuator 5. Movement of the piston in this manner will cause piston activation surface 22 to operatively engage second activation surface 8 on latching actuator 5. This action will cause latching actuator to pivot against the biasing influence of biasing element 6 and cause the retaining surface 30 of the latching actuator 5 to disengage from generally frusto conical member 41.

Figure 4:
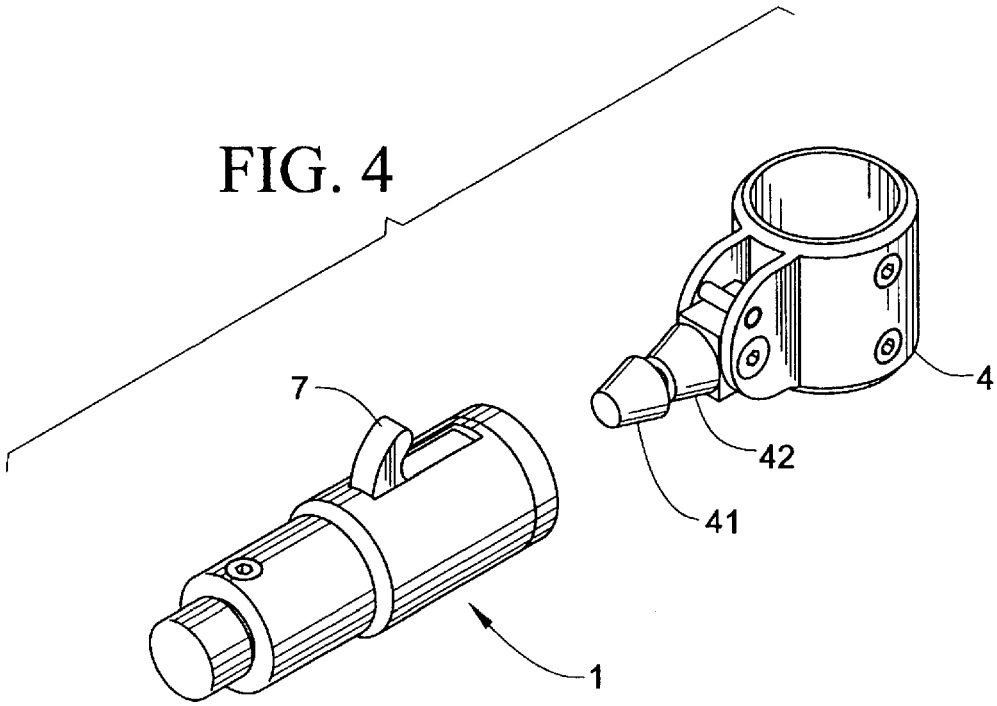
FIG. 4 is a pictorial view of the latching member and the auto locking member in an uncoupled relationship.
Figure 5:
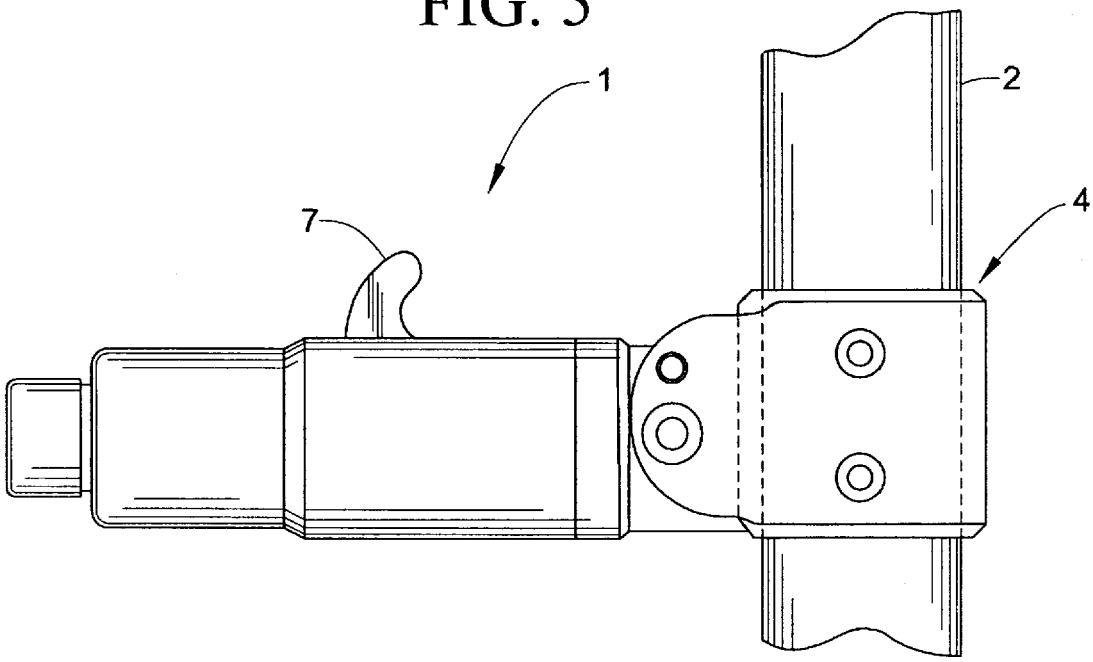
FIG. 5 is a side view of the latching member and outrigger mast in a coupled relationship with the auto locking member.

The manual actuator, located on the latching actuator, provide a convenient alternative to remote actuation while at the same time providing the added safety of a redundant operating alternative should the hydraulic system fail to actuate the release for whatever reason. FIGS. 4 and 5 illustrate the latching member 4 and mast 2 in coupled and uncoupled relationship with the auto locking member 1.

All patents and publications mentioned in this specification are indicative of the levels of those skilled in the art to which the invention pertains. All patents and publications are herein incorporated by reference to the same extent as if each individual publication was specifically and individually indicated to be incorporated by reference.

It is to be understood that while a certain form of the invention is illustrated, it is not to be limited to the specific form or arrangement herein described and shown. It will be apparent to those skilled in the art that various changes may be made without departing from the scope of the invention and the invention is not to be considered limited to what is shown and described in the specification and any drawings/figures included herein.

One skilled in the art will readily appreciate that the present invention is well adapted to carry out the objectives and obtain the ends and advantages mentioned, as well as those inherent therein. The embodiments, methods, procedures and techniques described herein are presently representative of the preferred embodiments, are intended to be exemplary and are not intended as limitations on the scope. Changes therein and other uses will occur to those skilled in the art which are encompassed within the spirit of the invention and are defined by the scope of the appended claims. Although the invention has been described in connection with specific preferred embodiments, it should be understood that the invention as claimed should not be unduly limited to such specific embodiments. Indeed, various modifications of the described modes for carrying out the invention which are obvious to those skilled in the art are intended to be within the scope of the following claims.

What is claimed is:

1. An outrigger securing assembly, for use on a fishing vessel comprising:

an automatic locking member adapted to be secured to a structural member of said vessel and a latching member adapted to be secured to an outrigger mast, said automatic locking member including a latching actuator which is capable of movement so as to engage and release said latching member;

a biasing element acting upon said latching actuator to hold said latching actuator into a position to engage the latching member;

a first activation surface on said latching actuator configured to be manually activated to move the latching actuator into a release position; and a second activation surface on said latching actuator configured to operatively engage a hydraulic actuator contained within the automatic locking member and move said latching actuator into a release position; whereby said latching member can be selectively released from said automatic locking member either manually or hydraulically.

2. The outrigger securing assembly of claim 1 wherein said hydraulic actuator includes a hydraulic piston carried for reciprocating movement within said automatic locking member, said automatic locking member including an inlet for admission of hydraulic fluid under pressure into a chamber contained with the automatic locking member, said chamber in fluid communication with a first end surface of said hydraulic piston, said piston further including a piston actuator surface on a second end surface of said hydraulic piston in operative engagement with said second activation surface on said latching actuator.

3. The outrigger securing assembly of claim 1 wherein said hydraulic piston includes a bore formed along a longitudinal axis of said hydraulic piston and extending from the second end surface of said hydraulic piston, and, mounted within said bore is a biasing member, the biasing member in operative engagement with the bore of the hydraulic piston and a bearing member, said bearing member being at least partially mounted within said bore and in operative engagement between said biasing member and said latching actuator.

4. The outrigger securing assembly of claim 3, wherein the hydraulic fluid in communication with the said chamber acts upon the said first surface of said piston with a first force and the biasing member carried within the piston bore acts upon said piston with a second force, and the first and second forces act upon the piston in opposite directions, whereby when the first force exceeds the second force the piston is moved in a direction away from the pressure chamber and towards the latching member thereby causing the bearing member to move into the bore and compress the resilient member carried within the piston bore.

5. The outrigger securing assembly of claim 4, wherein the second end surface of said hydraulic piston is formed as a conical surface, said conical surface moving into operative engagement with the second activation surface of said latching member when the first force exceeds the second force sufficiently so that the piston is moved in a direction towards the latching actuator.

6. The outrigger securing assembly of claim 1, wherein said latching actuator member is generally "L" shaped, said biasing element acting on a first end of said generally "L" shaped member, said generally "L" shaped member including a retaining portion on a second end of the generally "L" shaped member for engagement with said latching member, said generally "L" shaped member further including an aperture formed between the first and second end, said aperture receiving a pivot support member fixed to said automatic locking member, whereby said generally "L" shaped member is pivotally mounted within the automatic locking member.

7. The outrigger securing assembly of claim 6, wherein said first activation surface on said latching actuator member is a trigger like protrusion that extends from the generally "L" shaped member to a location external of the automatic locking member.

8. The outrigger securing assembly of claim 1 wherein said latching member includes a pair of clamps configured to conform to the outer surface of a mast so that said latching member is capable of being secured to a said mast.

9. The outrigger securing assembly of claim 1, wherein said latching member further includes a first generally frusto conical member having a first flat surface and a second flat surface and a conical surface, said first generally frusto conical member further including a rounded surface interposed between said conical surface and said second flat surface said first generally frusto conical member in operative engagement with said latching actuator member to hold the latching member to the automatic locking member in a first position and release the latching member from the locking member in a second position.

10. The outrigger securing assembly of claim 9, wherein said latching member further includes a second generally frusto conical member having a third flat face, a forth flat face and a generally conical surface there between.

11. The outrigger securing assembly of claim 10, wherein said latching member further includes means to secure said first generally frusto conical member to said second generally frusto conical member and said pair of clamps.

12. The outrigger securing assembly of claim 10, wherein said automatic locking member includes a resilient annular member secured to an opening thereon, said resilient annular member cooperating with said first generally frusto conical member and said second generally frusto conical member to align and position the latching member within said automatic locking member and engage and disengage from said latching actuator member.

* * * * *